US007891984B1

(12) United States Patent
Ju

(10) Patent No.: US 7,891,984 B1
(45) Date of Patent: Feb. 22, 2011

(54) ELECTRICAL CONNECTOR

(75) Inventor: Ted Ju, Keelung (TW)

(73) Assignee: Lotes Co., Ltd., Keelung (TW)

( * ) Notice: Subject to any disclaimer, the term of this patent is extended or adjusted under 35 U.S.C. 154(b) by 0 days.

(21) Appl. No.: 12/854,389

(22) Filed: Aug. 11, 2010

(30) Foreign Application Priority Data

Jan. 29, 2010 (CN) ..... 2010 2 0104404 U

(51) Int. Cl.
*H01R 12/00* (2006.01)

(52) U.S. Cl. ..... 439/66

(58) Field of Classification Search ..... 439/66, 439/67, 77, 91, 65
See application file for complete search history.

(56) References Cited

U.S. PATENT DOCUMENTS 6,719,569 B2 * 4/2004 Ochiai ..... 439/66
7,025,601 B2 * 4/2006 Dittmann ..... 439/66
7,371,073 B2 * 5/2008 Williams ..... 439/66

* cited by examiner

*Primary Examiner*—Tho D Ta
(74) *Attorney, Agent, or Firm*—Rosenberg, Klein & Lee

(57) ABSTRACT

An electrical connector includes at least one first insulating substrate having first tongues, at least one second insulating substrate having second tongues, and a plurality of contacts. One end of the first tongue connects to the first insulating substrate. There are through-holes in the first insulating substrate for the second tongues to pass through. One end of the second tongue connects to the second insulating substrate. With respect to the upper surface of the first insulating substrate, the other end of the first insulating substrates defines a first height difference, the other end of the second tongue defines a second height difference and the upper-most portion of the contact defines a third height difference which is larger than the first and second height differences. There are holes in the second insulating substrate for exposing the contacts.

10 Claims, 8 Drawing Sheets

ELECTRICAL CONNECTOR

BACKGROUND OF THE INVENTION

1. Field of the Invention

The present invention relates to an electrical connector. In particular, the present invention relates to an electrical connector that electrically connects a chip module to a circuit board.

2. Description of Related Art

Currently, a typical electrical connector for electrically connecting a chip module to a circuit board usually comprises an insulating body and a plurality of contacts (pins) arranged therein. Conventionally, the insulating body and the contacts are manufactured separately. Thus, a plastic mold is required for manufacturing the insulating body, and a metal forming mold is required for manufacturing the contacts. Then the contacts are plugged into the insulating body by manual labor or by automated machines in the assembly process to complete the electrical connector.

However, said conventional electrical connector has the following drawbacks:

1. Manufacturing cost of the electrical connector tends to increase by the necessity of a plastic mold for the insulating body and a metal forming mold for the contacts.

2. Manufacturing cost of the electrical connector is also increased by too much waste material generated during the forming process of the contacts, as the metal material is very high-priced and there are a large quantity of contacts used for mass production.

3. It takes too much time and labor to plug the contacts into the insulating body as they are separated from each other.

Furthermore, as electronic devices tend to become thinner, smaller, and easier to carry, the insulating body for the electrical connector also needs to be thinner. However, the plastic-made insulating body becomes too easily broken when it gets too thin.

SUMMARY OF THE INVENTION

One particular aspect of the present invention is to provide an electrical connector whose height is low and is low cost to manufacture.

To achieve the above objectives, the electrical connector includes at least one first insulating substrate that is cut to form a plurality of first tongues, wherein one end of the first tongue connects to the first insulating substrate, a first height difference is defined between the other end of the first tongue and the first insulating substrate, and a through-hole is formed on the first insulating substrate at each location corresponding to each first tongue; at least one second insulating substrate that is cut to form a plurality of second tongues, wherein each of the second tongues passes through the through-hole, one end of the second tongue connects to the second insulating substrate, and a second height difference is defined between the other end of the second tongue and the first insulating substrate; and a plurality of contacts adhered between the first tongues and the second tongues, wherein the contact passes through the through-hole, and a third height difference is defined between the contact and the first insulating substrate; wherein the third height difference is larger than the first and second height difference, and a hole is formed on the second insulating substrate at each location corresponding to each contact for exposing the contact from the second insulating substrate.

The present invention offers the following advantages over the discussed prior art. The contacts of the electrical connector of the present invention are adhered between the first and second insulating substrate. Neither plastic mold nor metal forming mold is required. Moreover, the contacts do not need to be plugged by manual labor or machine to make an electrical connector, thus reducing the height of electrical connector as well as the manufacturing cost.

For further understanding of the present invention, reference is made to the following detailed description illustrating the embodiments and examples of the present invention. The description is for illustrative purpose only and is not intended to limit the scope of the claim.

DETAILED DESCRIPTION OF THE PREFERRED EMBODIMENTS

Figure 1A:
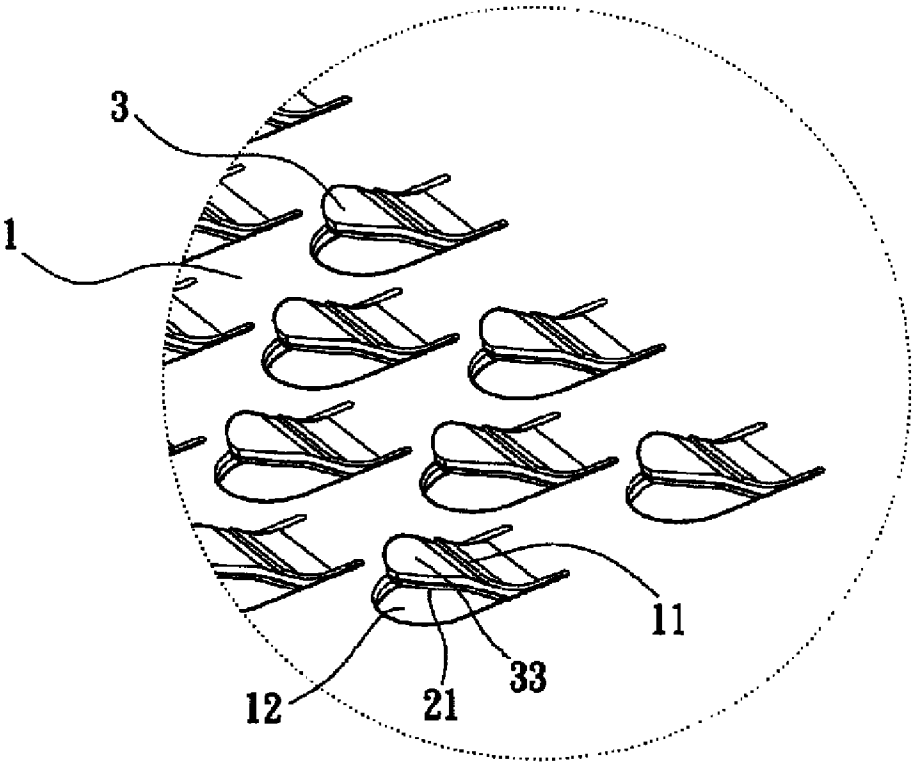
FIG. 1 is a perspective view of the electrical connector of the first embodiment of the present invention.
Figure 1:
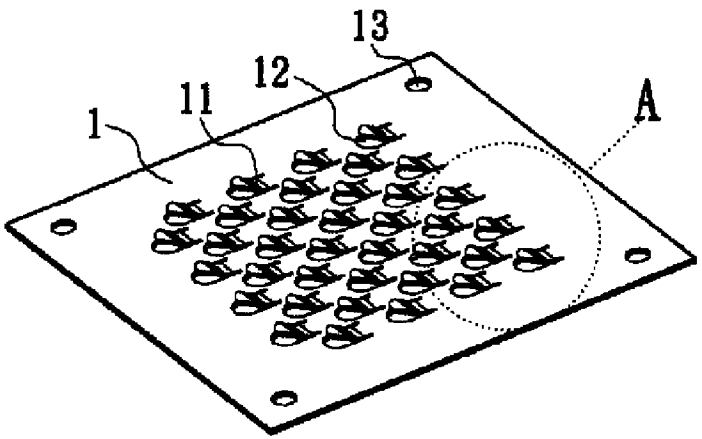
Figure 2A:
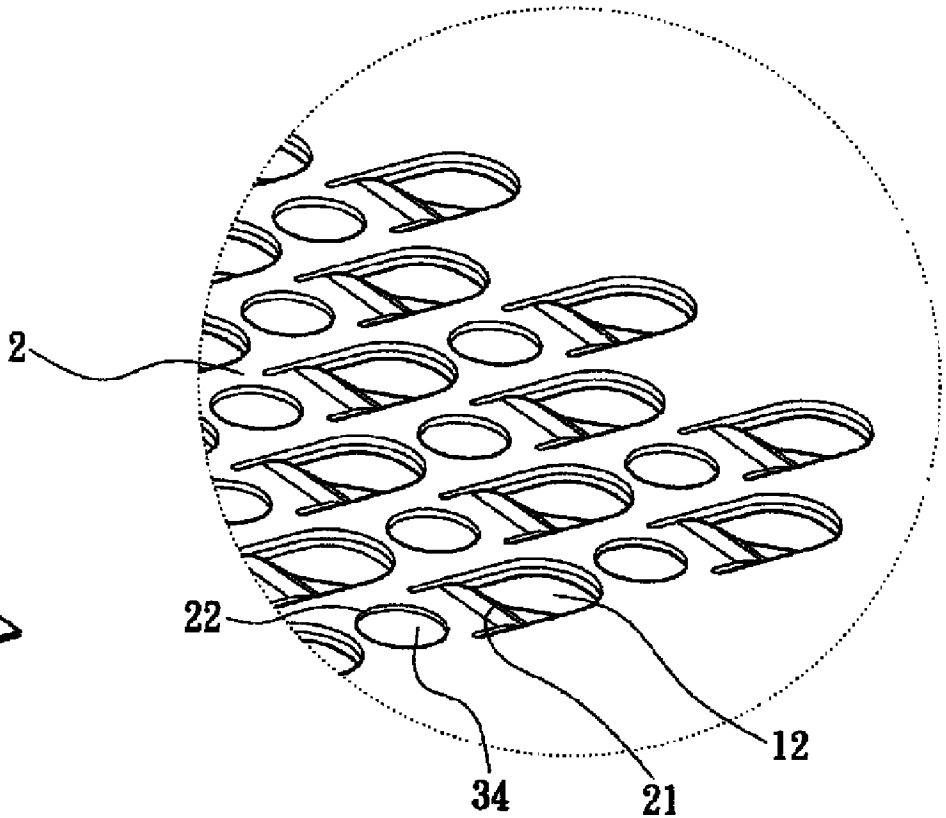
FIG. 2 is another perspective view of the electrical connector of FIG. 1.
Figure 2:
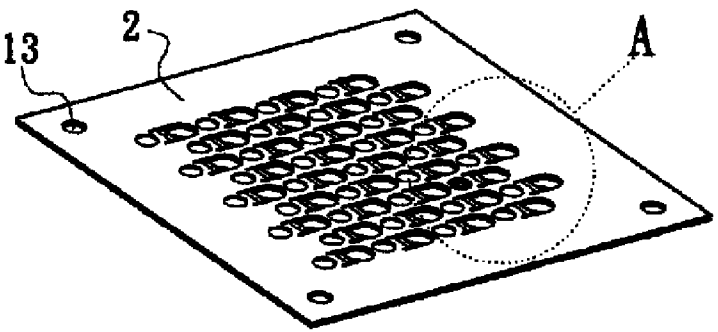
Figure 3:
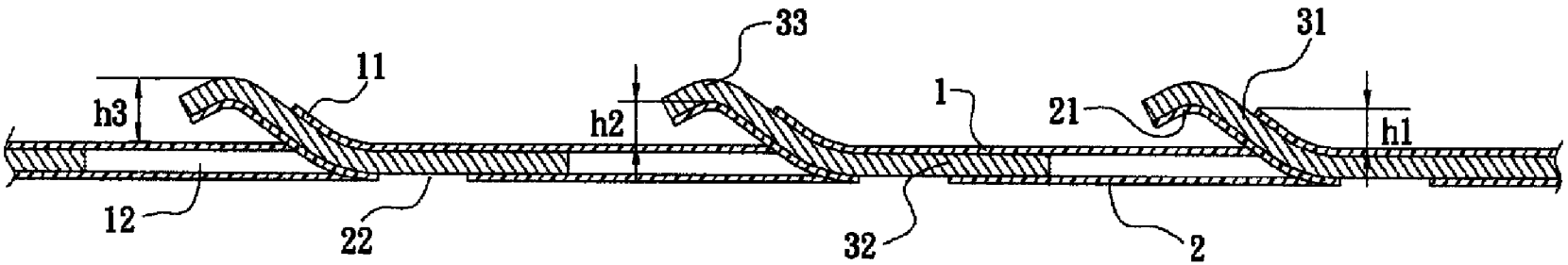
FIG. 3 is a partial sectional view of the electrical connector of FIG. 1.

Reference is made to FIGS. 1 to 3, which show the first embodiment of the electrical connector 100 of the present invention. The electrical connector 100 includes a first insulating substrate 1, a second insulating substrate 2, positioning pins 4, positioning blocks 5, and a plurality of contacts 3 adhered between the first and second insulating substrate 1, 2.

The first and second insulating substrate 1, 2 are made of soft materials and the first insulating substrate 1 is cut to form a plurality of first tongues 11 while the second insulating substrate 2 is cut to form a plurality of second tongues 21, in addition, each first tongue 11 corresponds to one second tongue 21. The first insulating substrate 1 is formed with a plurality of through-holes 12 at each location corresponding to each first tongue. The second insulating substrate 2 is also formed with a plurality of through-holes 12 at each location corresponding to each second tongue. The first and second insulating substrate 1, 2 are stacked together (they may be adhered into one piece, or not), and the through-holes 12 on the first insulating substrate 1 substantially overlap those on the second insulating substrate correspondingly, thus, the overlapping holes can be treated as one single hole. Furthermore, there is a plurality of overlapping positioning holes 13 (more than two) in the first and second insulating substrate 1, 2 disposed around the edges thereof.

The contact 3 is flake-shaped, made of copper or other metals with good conductivity, and is adhered between the first and second tongues 11, 21. In the lengthwise direction, the contact 3 has a first end 31 and a second end 32. The first end 31 is far away from the through-holes 12, while the second end 32 is near the through-holes 12. The first tongue 11, the second tongue 21 and the upper-most portion of the contact 3 respectively defines a first height difference h1, a second height difference h2 and a third height difference h3 with respect to the upper surface of the first insulating substrate 1. The third height difference h3 is larger than the first and second height difference h1, h2. As the direction shown in FIG. 3, the first tongue 11 is defined as being located at the upper side and the second tongue 21 at the lower side. The first tongue 11 does not fully cover the contact 3. The exposed portion of the contact 3 forms a contact portion 33, and is located at the upper-most portion. The second insulating substrate 2 has holes 22 at each location corresponding to each second end 32 of the contacts 3, so that part of the contact 3 exposes from the second insulating substrate 2 to form a welding portion 34.

Figure 4:
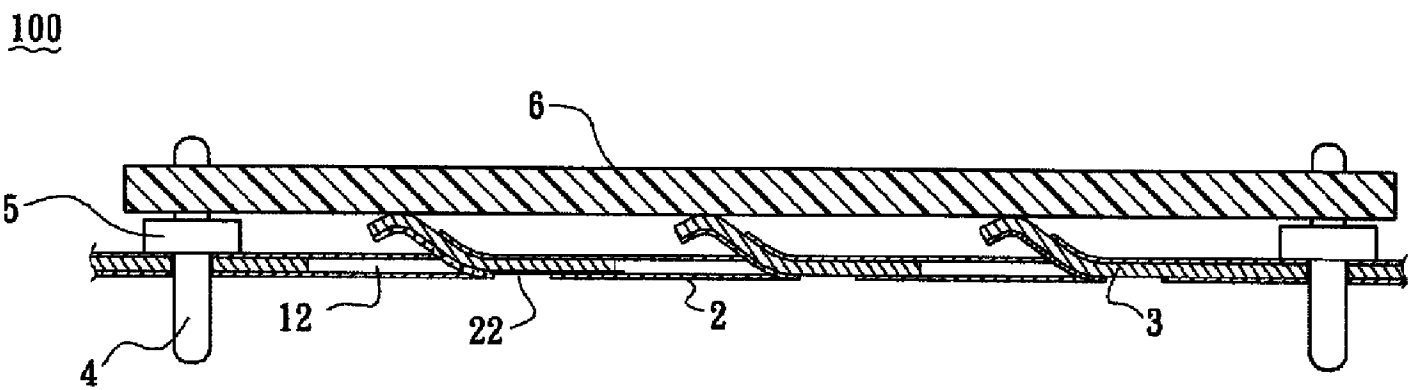
FIG. 4 is a schematic diagram of a pick up cap fixed onto the electrical connector of FIG. 1.
Figure 5:
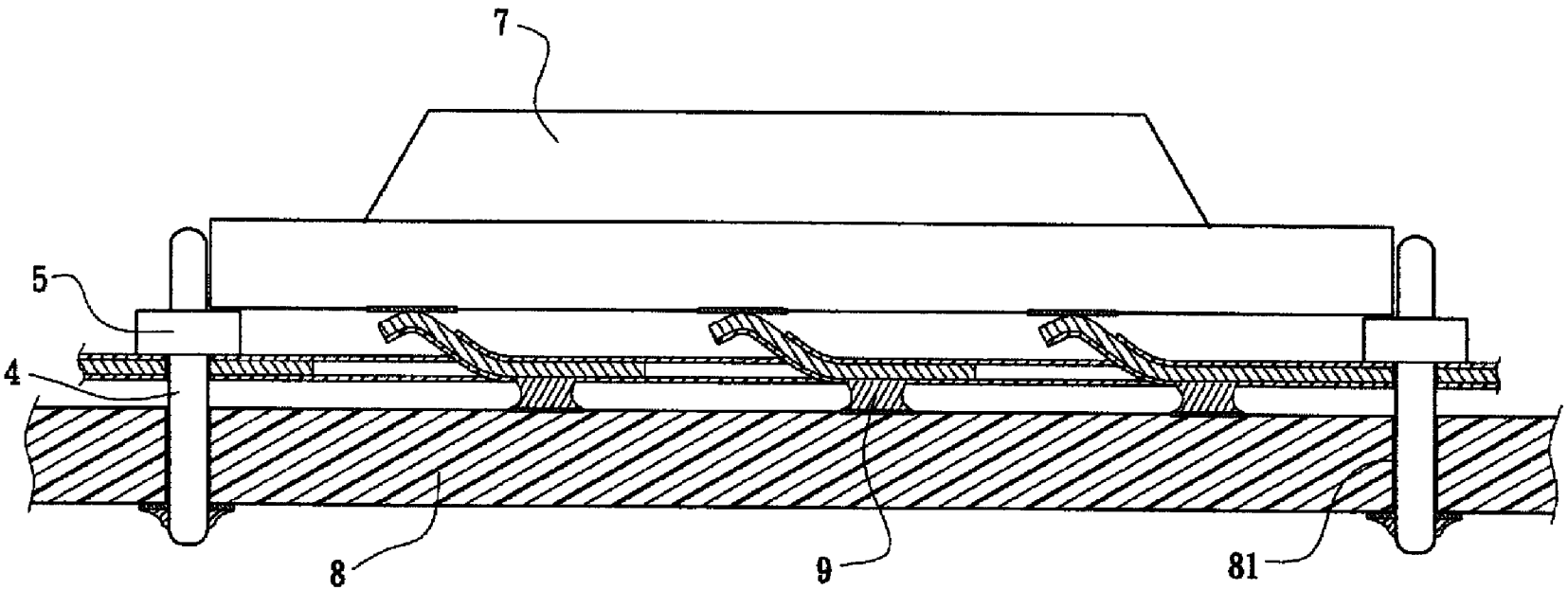
FIG. 5 is a view showing a first alternative embodiment of the electrical connector of FIG. 1 connecting two corresponding electrical elements.

As shown in FIGS. 4 and 5, the electrical connector 100 is used for connecting two corresponding electrical elements. In this embodiment, said two corresponding electrical elements are a chip module 7 and a circuit board 8. Because the first and second insulating substrate 1, 2 are made of soft material, each insulating substrate stack is stretched into a plane by passing the positioning pins 4 through the positioning holes 13 during the installation. Furthermore, a plurality of positioning blocks 5 are fixed on the positioning pins 4, and a pick up cap 6 with matching hole patterns (not shown in the figure) is supported by the positioning blocks 5 after being installed through the positioning pins 4. During assembly process, an automation device can catch the electrical connector 100 to place it on the circuit board 8. The pick up cap 6 can be treated as a part of the electrical connector 100. The circuit board 8 has opening 81 for mounting the positioning pins 4. The positioning pins 4 are soldered onto the bottom surface of the circuit board 8. After removal of the pick up cap 6, the chip module 7 is placed on the electrical connector 100 and is supported by the positioning blocks 5. The positioning pin 4 can be a screw or bolt, and the positioning block 5 can be a nut. When the chip module 7 is pressed to contact the contact portion 33, the chip module 7 will not be pressed too far down due to the support of the positioning blocks 5. Thus, the problem of plastic deformation of the contact 3 is avoided. The welding portion 34 is soldered onto the circuit board 8 by a soldering material 9.

Figure 6:
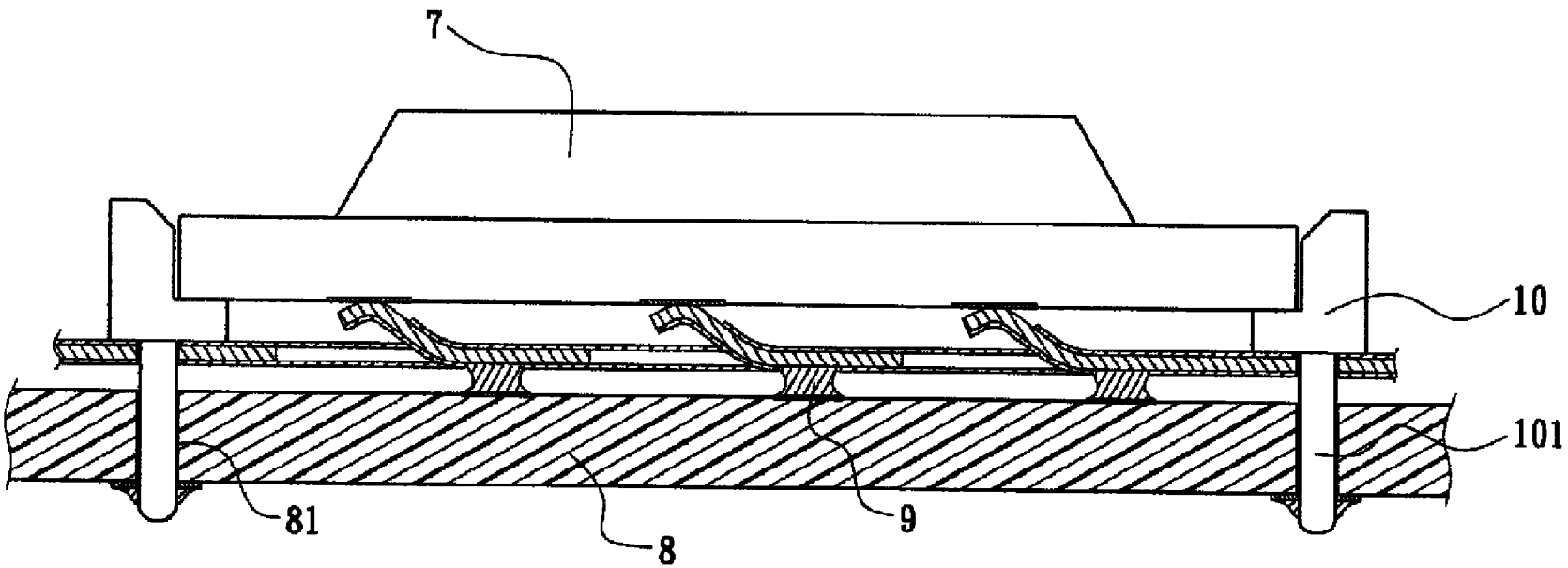
FIG. 6 is a view showing a second alternative embodiment to that of FIG. 5.

As shown in FIG. 6, the positioning pins 4 and the positioning blocks 5 can be replaced by a positioning frame 10 with positioning legs 101. The function of the positioning legs 101 is the same as that of the positioning pins 4. Thus, the positioning 101 pass through the positioning holes 13 and the first and second insulating substrates 1, 2 are substantially stretched into a plane. Furthermore, the chip module 7 is supported by the positioning frame 101 to prevent the chip module 7 from being pressed too far down.

Figure 7:
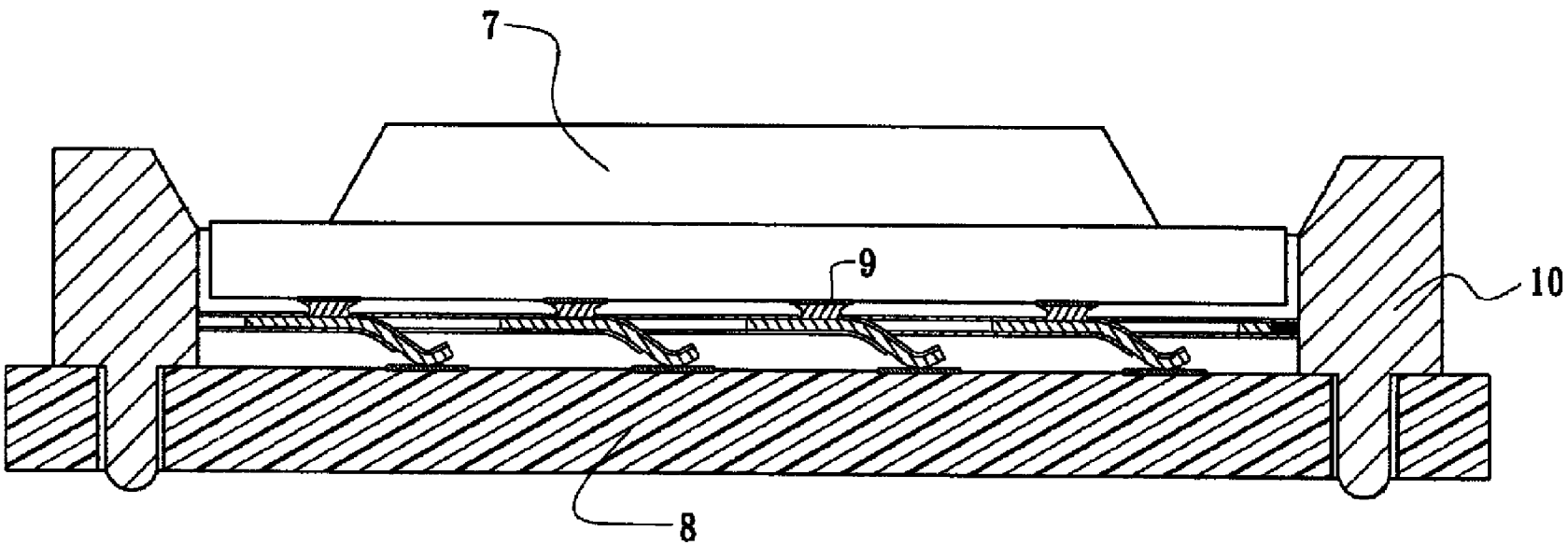
FIG. 7 is a view showing a third alternative embodiment to that of FIG. 5.

As shown in FIG. 7, the electrical connector 100 can be used in another way. Instead of being mounted on a circuit board 8, the welding portion 34 is soldered on the chip module 7 by soldering material 9, while the contact portion 33 is pressed to contact the circuit board 8. Because the electrical connector 100 is supported by the positioning frame 10, the electrical connector 100 will not be pressed too far down and the problem of plastic deformation in the contact 3 is avoided.

Figure 8:
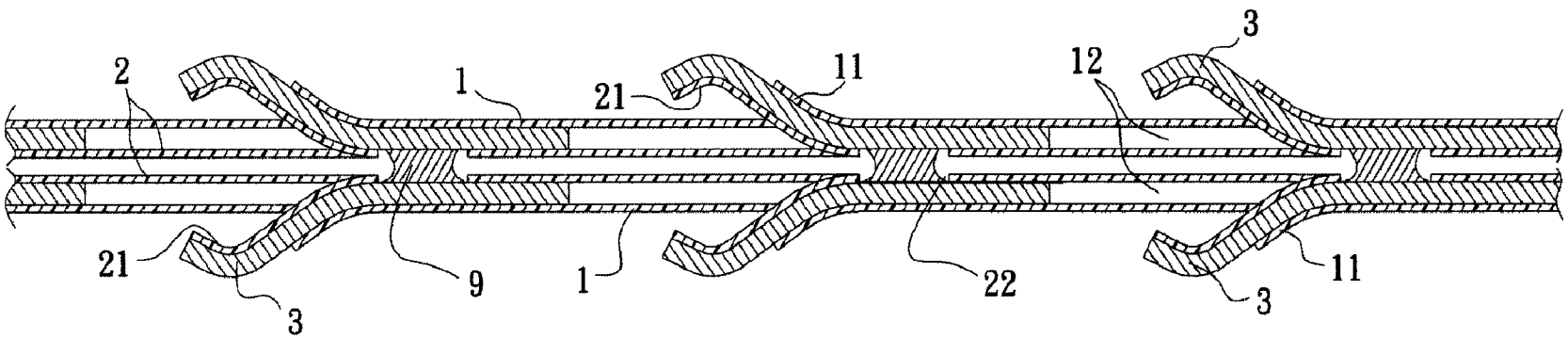
FIG. 8 is a partial sectional view showing a second alternative embodiment to that of FIG. 3.

FIG. 8 is the electrical connector 100 of the second embodiment. The difference between the second and first embodiments is: this electrical connector 100 comprises two first insulating substrates 1 and two second insulating substrates 2, in addition, said two second insulating substrates 2 are stacked to form a single piece (the stack may be an integral piece structure, but not necessary). The welding portions 34 (FIG. 2A) are jointed together correspondingly by soldering material 9 in the hole 22. The electrical connector 100 is pressed between the chip module 7 and the circuit board 8 to establish electrical connection.

Figure 9:
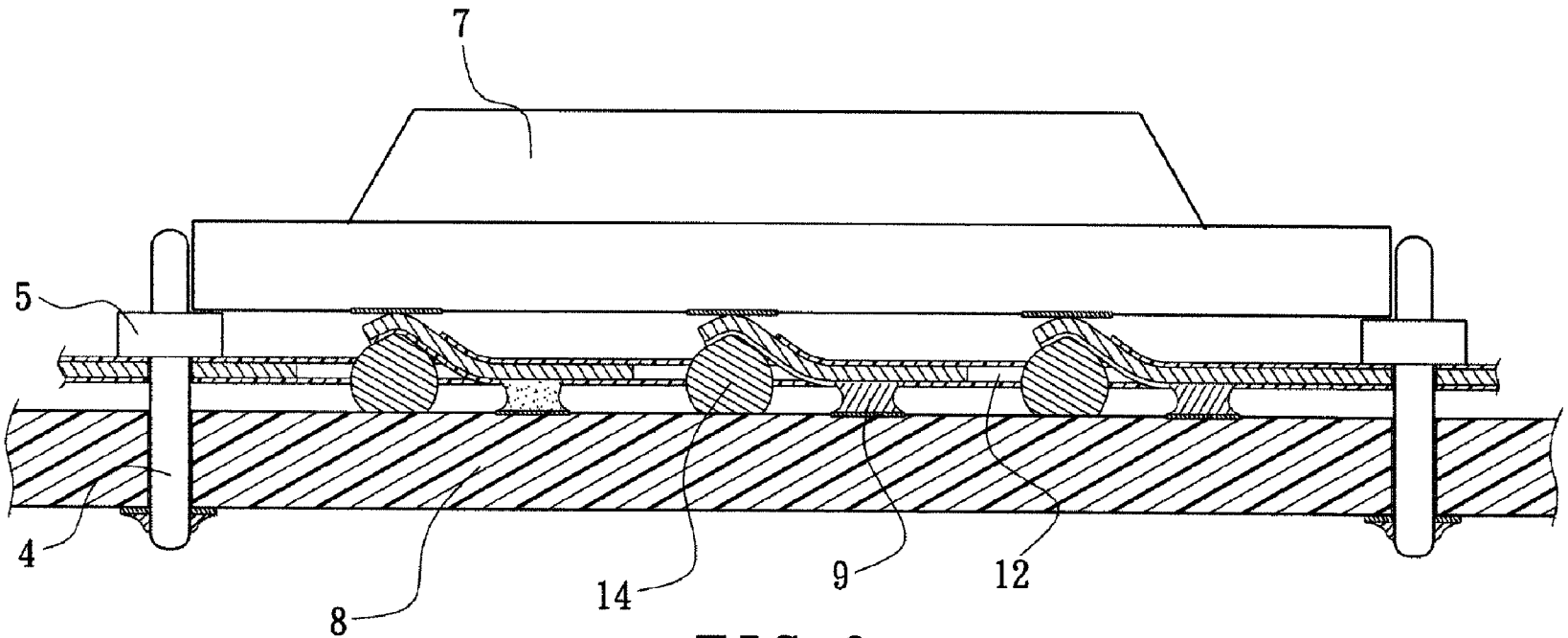
FIG. 9 is a partial sectional view of the third embodiment of the present invention connecting two corresponding electrical elements.

FIG. 9 is the electrical connector 100 of the third embodiment. The difference between the third and first embodiments is: there are elastomers 14 located below the contact 3 and each of them is received in one through-hole 12 correspondingly. The elastomers 4 on the circuit board 8 provides elastic support for the contact 3

In the above embodiments, the material of the second insulating substrate 2 may be the same as the first insulating substrate 1, although not necessary. Moreover, the material can be insulating paints (such as green paint) or PI (PolyImide) materials. The electrical connector 100 of the present invention has the following characteristics.

1. The contact 3 is adhered between the first and second insulating substrate 1, 2. Neither a plastic mold is required for forming the first and second insulating substrate 1, 2, nor a metal forming mold is required for forming the contacts 3. Moreover, the contacts 3 do not need to be plugged into the first 1 and second insulating substrate 2 by manual labor or by automated machines, so the manufacturing cost is reduced.

2. Manufacturing cost of the electrical connector is also reduced for the utilizing rate of the material of the contacts 3 is increased by using the adhering method.

3. The contacts 3 will not be broken even though the chip module 7 is pressed to the contacts 3 by a large force thanks to the first and second insulating substrate 1, 2 being made of soft material.

4. The thickness of the first and second insulating substrate 1, 2 can be very thin as they are made of soft material. The positioning frame 10 also can be thinner as long as it is strong enough to support the first and second insulating substrate 1, 2. As a result, the height of the electrical connector 100 can be reduced.

5. When the chip module 7 is mounted on the positioning frame 10, the contacts 3 are pressed by the chip module 7 and deformed. The height differences (h1, h2, h3) provide a space to allow elastic deformation for the contacts 3. When the chip module 7 presses the contacts 3 with a larger force, the through-holes 12 also provide an elastic deformation space for the contacts 3.

6. By locating the positioning pins 4 and positioning blocks 5 or the positioning frame 10, the first and second insulating substrate 1, 2 made of soft material can be stretched into a plane to increase the strength. The electrical connector 100 will not be warped.

7. The elastomers 14 increase elasticity of the contact 3 and the contacting normal force between the contact 3 and the chip module 7.

The description above only illustrates specific embodiments and examples of the present invention. The present invention should therefore cover various modifications and variations made to the herein-described structure and operations of the present invention, provided they fall within the scope of the present invention as defined in the following appended claims.

What is claimed is:

1. An electrical connector, comprising:

at least one first insulating substrate having a plurality of first tongues, wherein one end of the first tongue connects to the first insulating substrate, and a first height difference is defined between the other end of the first tongue and the upper surface of the first insulating substrate, wherein a through-hole is formed on the first insulating substrate at each location corresponding to each first tongue;

at least one second insulating substrate having a plurality of second tongues, wherein each second tongue passes through the through-hole of the first insulating substrate, and connects to the second insulating substrate at one end, wherein a second height difference is defined between the other end of the second tongue and the upper surface of the first insulating substrate; and a plurality of contacts adhered between the first tongues and the second tongues, wherein the contacts pass through the through-holes of the first insulating substrate, wherein a third height difference is defined between the upper-most portion of the contact and the first insulating substrate, and wherein the third height difference is larger than the first height difference and the second height difference;

wherein there is a hole on the second insulating substrate at each location corresponding to each contact for exposing the contact from the second insulating substrate.

2. The electrical connector as claimed in claim 1, wherein the second insulating substrate is adhered onto the first insulating substrate.

3. The electrical connector as claimed in claim 1, further comprising a plurality of elastomers, wherein each elastomer is located below one contact for supporting the contact.

4. The electrical connector as claimed in claim 1, comprising two first insulating substrates and two second insulating substrates, wherein the two second insulating substrates are adhered to each other, and a soldering material is located in the holes of the two second insulating substrates to joint the corresponding upper and lower contacts.

5. The electrical connector as claimed in claim 1, wherein the first and second insulating substrates are made of soft materials.

6. The electrical connector as claimed in claim 1, wherein the first and second insulating substrates are made of different materials.

7. The electrical connector as claimed in claim 1, wherein the contact is made of copper.

8. The electrical connector as claimed in claim 1, further comprising a positioning frame, wherein the positioning frame is mounted on the side of the first insulating substrate not facing the second insulating substrate.

9. The electrical connector as claimed in claim 8, further comprising a pick up cap, wherein the pick up cap is mounted on the side of the first insulating substrate not facing the second insulating substrate, and is supported by the positioning frame.

10. The electrical connector as claimed in claim 8, wherein there are at least two legs in the positioning frame, and overlapping position holes in the first and second insulating substrate, wherein the positioning legs pass through the positioning holes.

* * * * *